US005580056A

United States Patent [19]

Clark

[11] Patent Number: 5,580,056

[45] Date of Patent: Dec. 3, 1996

[54] BLOCK PUZZLE ILLUSION OF MATTER CREATED AND DESTROYED

[76] Inventor: Dean Clark, 63 Potter St., Cranston, R.I. 02910

[21] Appl. No.: 503,855

[22] Filed: Jul. 18, 1995

[51] Int. Cl.[6] ..... A63F 9/12

[52] U.S. Cl. ..... 273/157 R; 273/160

[58] Field of Search ..... 273/153 R, 157 R, 273/160, 156

[56] References Cited

U.S. PATENT DOCUMENTS

| | | | |
|---|---|---|---|
| 3,645,535 | 2/1972 | Randolph | 273/160 |
| 4,133,152 | 1/1979 | Penrose . | |
| 4,278,116 | 3/1983 | Rubik . | |
| 4,308,016 | 12/1981 | White | 273/157 R |
| 4,521,024 | 6/1985 | Slade . | |
| 4,522,404 | 6/1985 | Di Gregorio | 273/157 R |

FOREIGN PATENT DOCUMENTS

| | | | |
|---|---|---|---|
| 2190848 | 12/1987 | United Kingdom | 273/157 R |

OTHER PUBLICATIONS

Gardner, Martin; Mathematics, Magic and Myster, 1956; pp. 129–155.

*Primary Examiner*—Steven B. Wong
*Attorney, Agent, or Firm*—Salter & Michaelson

[57] ABSTRACT

A cubic puzzle construction utilizes a mathematical technique of dissecting a physical cube into a finite number of pieces to yield a block puzzle capable of the illusion of matter being created and destroyed. The component pieces are assembled in two different ways to produce the same cubic shape. However, one method of assembly requires the use of an additional piece or pieces while the second method omits these. In both methods the rigid pieces fit easily, without gaps or overlaps, to completely fill the same rigid container.

12 Claims, 17 Drawing Sheets

BLOCK PUZZLE ILLUSION OF MATTER CREATED AND DESTROYED

BACKGROUND AND SUMMARY OF THE INVENTION

The instant invention relates, within classical number theory, to certain Diophantine equations which arise in connection with the greatest common divisor (gcd) of a set of positive integers. Within analytical geometry, such equations describe planar surfaces in three-dimensional Euclidean space. The individual designs that flow from the instant invention are spatial realizations of these number-theoretic and geometrical concepts, sharing with other block puzzles the common feature that the component pieces must be rearranged in space to achieve specified effects. The invention is thus further related to packing problems seen in the field of combinatorial geometry. Most significantly for the present invention, each design comprises a three-dimensional embodiment of a changing-area paradox previously known only in two dimensions.

Changing area paradoxes in the two-dimensional plane have been known since at least the time of Lewis Carroll. In one of Carroll's favorites, an 8×8 chessboard is cut into four pieces, which are then rearranged to produce a 5×13 rectangle resulting in an apparent increase of one square unit of area. A 13×13 variation of Carroll's paradox rearranged into an 8×21 rectangle is illustrated in FIGS. 1A and 1B.

Magician Paul Curry developed a variation which preserves the square shape throughout. However, Curry's variation reveals a missing area V in the form of an empty interior square when the pieces are rearranged (See FIGS. 2A and 2B). There is evidently no systematic analysis of these so-called Curry Squares in print, i.e., one that makes the connection with the classical theory of the gcd and its associated Diophantine equation.

A two-dimensional relative of the instant puzzle construction is illustrated in FIGS. 3A and 3B. This puzzle construction comprises a 13×13 square which is divided into four pieces as illustrated. The original puzzle construction in FIG. 3A has no voids, and thus comprises 169 units. However, when the four pieces are rearranged as illustrated, a square void V equal to one square unit is formed in the middle of the construction, indicating that there are only 168 units left, i.e. one of the units now appears to be missing. This puzzle thus represents a reduction of the number of pieces in Curry's puzzle from five to four, which was something Curry and others tried to accomplish, apparently without success, subject to the conditions that the void not appear on the boundary of the completed square, and none of the pieces are allowed to be flipped over.

Heretofore there have been no known examples of truly three-dimensional paradoxes of changing volume, nor any theory of such constructions. Although it is clear that a two-dimensional construction can be artificially extended to three dimensions simply by adding thickness to the flat pieces, such artificial extensions are taken to be plainly inferior, and in any case do not achieve the same effect as the present invention.

The instant invention provides a mathematical technique of dissecting a physical cube into a finite number of component pieces, or blocks, with two possible methods of assembling the blocks into the original cubic shape. The two methods of assembly differ in that one of the configurations leaves a conspicuous void requiring the use of an additional block or blocks, i.e., pieces not included in the original collection, to restore all of the volume of the original cube. Because these dissections are never unique, and depend on the dimensions of the original cube, the number of possible realizations is indeterminately large. However, the individual cases are manifestly similar and will not be seen as departing from the general method of the present invention.

A typical construction of the component blocks begins by slicing a cube along a plane which begins at the southwest bottom corner of the cube and extends to the northeast top corner, thus separating the cube into upper and lower block portions with a planar interface. The top portion usually serves only to restore the cubic shape after further dissections and rearrangements are performed on the lower portion. The lower portion of the severed cube receives two vertical planar cuts which are parallel to the sides of the cube and perpendicular to each other. Thus, the lower portion of the cube is dissected into four sections. The northeast of these four sections receives an additional planar cut parallel to the base of the cube, so as to separate the section into top and bottom pieces, wherein the bottom piece comprises the tallest possible rectangle of integer height formed from the section. Depending on the original dimensions of the cube, further dissections are performed on bottom rectangular piece to divide it into a plurality of rectangular component elements. It is then possible to rearrange all the pieces in space so that the original cubic shape is restored, with the exception of a conspicuous void of cubic volume which may be interior to the restored cube or on its boundary. The size of this void depends on the dimensions of the original cube. Filling it requires an additional cubic piece or pieces, i.e., blocks not included in the totality of pieces used to configure the original cube.

Accordingly, among the several objects of the invention are: the provision of a method for dissecting a cubic block into a finite number of components to form a puzzle; the provision of a block puzzle comprising the original dissected components, plus an additional cubic element to be added when reconstructing the puzzle; and the provision of a method of reassembling the components, along with the additional cubic element into the puzzle's original cubic shape such that there is no apparent increase in volume of the original cubic shape.

Other objects, features and advantages of the invention shall become apparent as the description thereof proceeds when considered in connection with the accompanying illustrative drawings.

DETAILED DESCRIPTION OF THE EMBODIMENTS

(I)

Figure 1A:
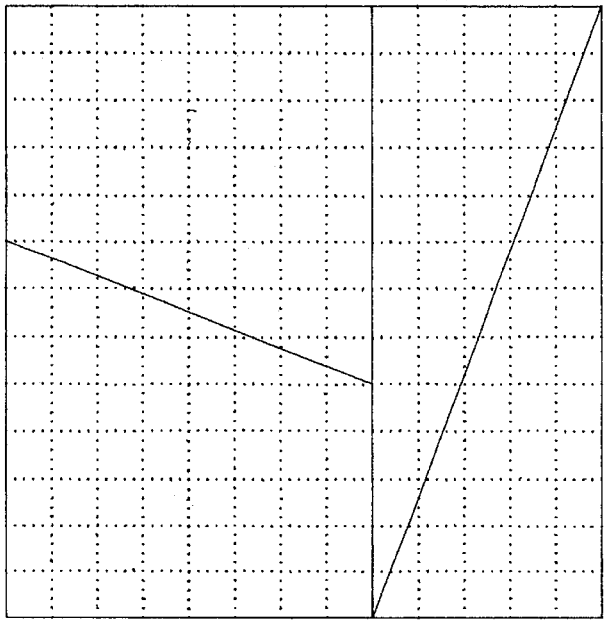
FIG. 1A (PRIOR ART)
FIGS. 1A and 1B show an instance of Lewis Carroll's two-dimensional paradox with a 13×13 square.
Figure 1B:
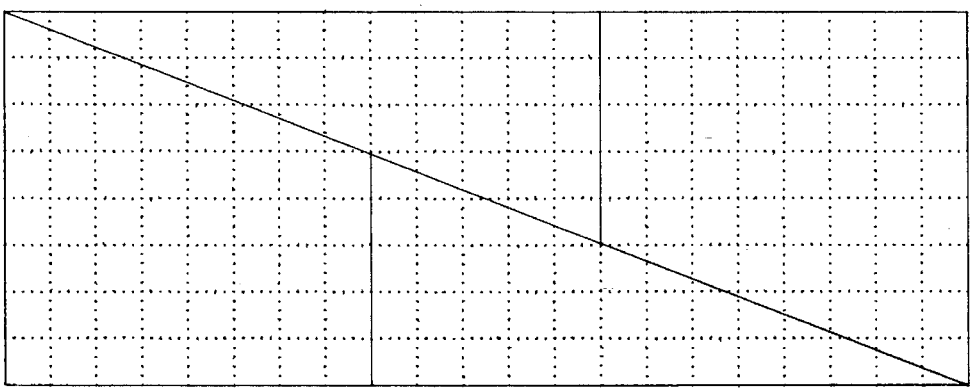
FIG. 1B (PRIOR ART)
Figure 2A:
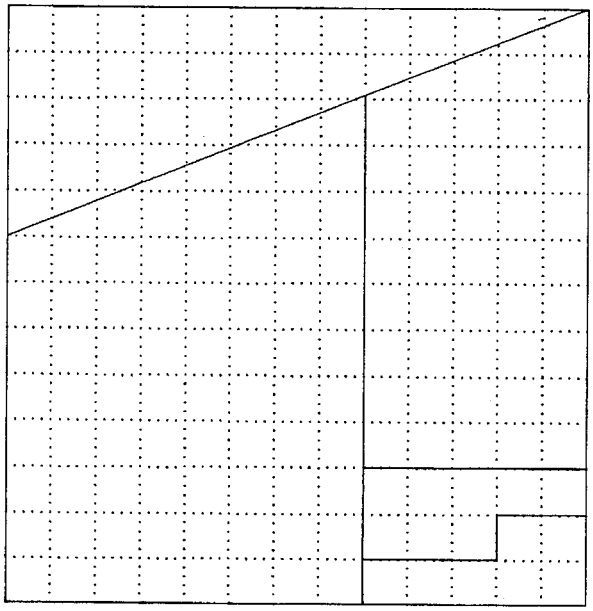
FIG. 2A (PRIOR ART)
FIGS. 2A and 2B show Paul Curry's variation.
Figure 2B:
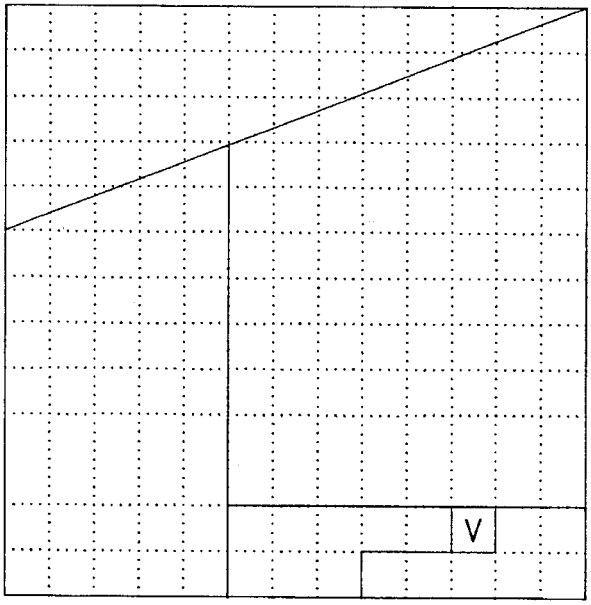
FIG. 2B (PRIOR ART)
Figure 3A:
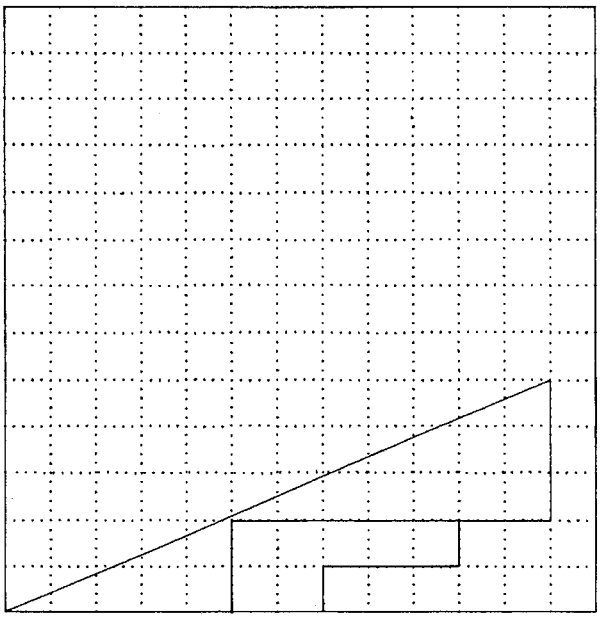
FIGS. 3A and 3B show a two-dimensional relative of the present invention.
Figure 3B:
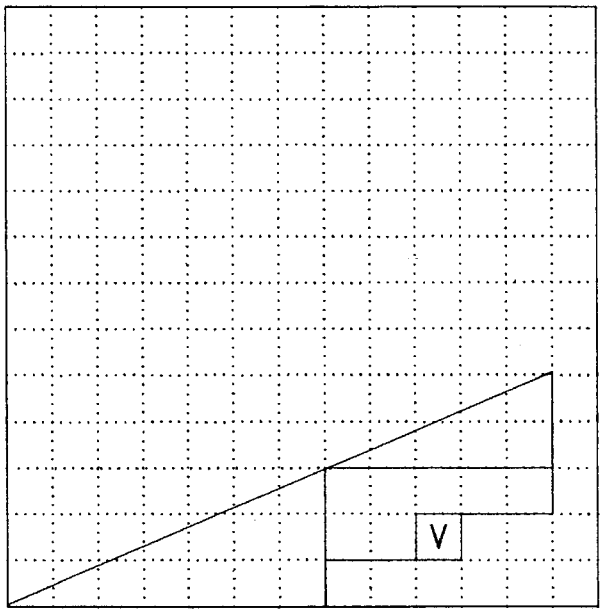
Figure 4:
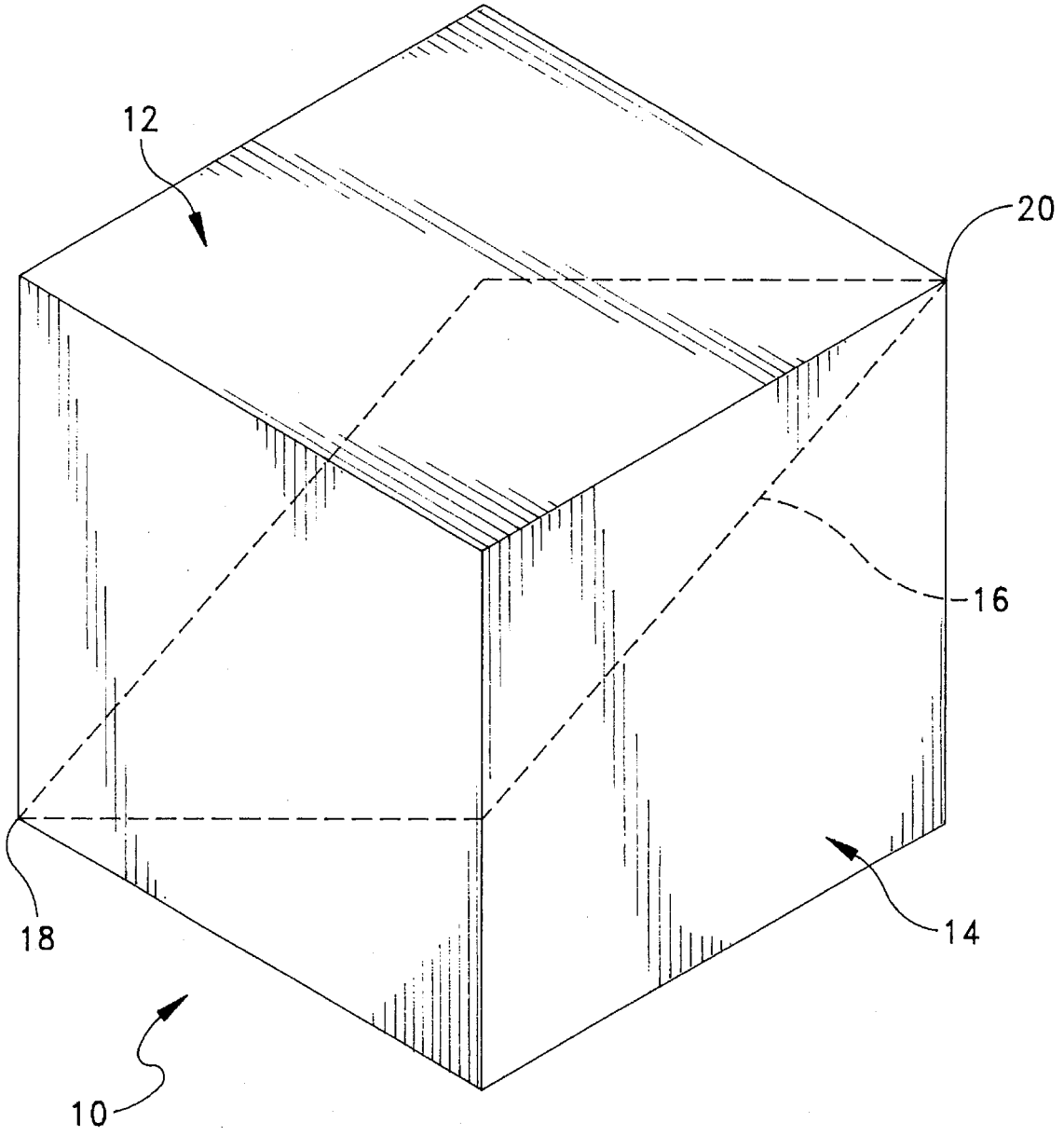
FIG. 4 is a perspective view of an 8×8×8 cube truncated along a predetermined plane into upper and lower block portions.
Figure 5:
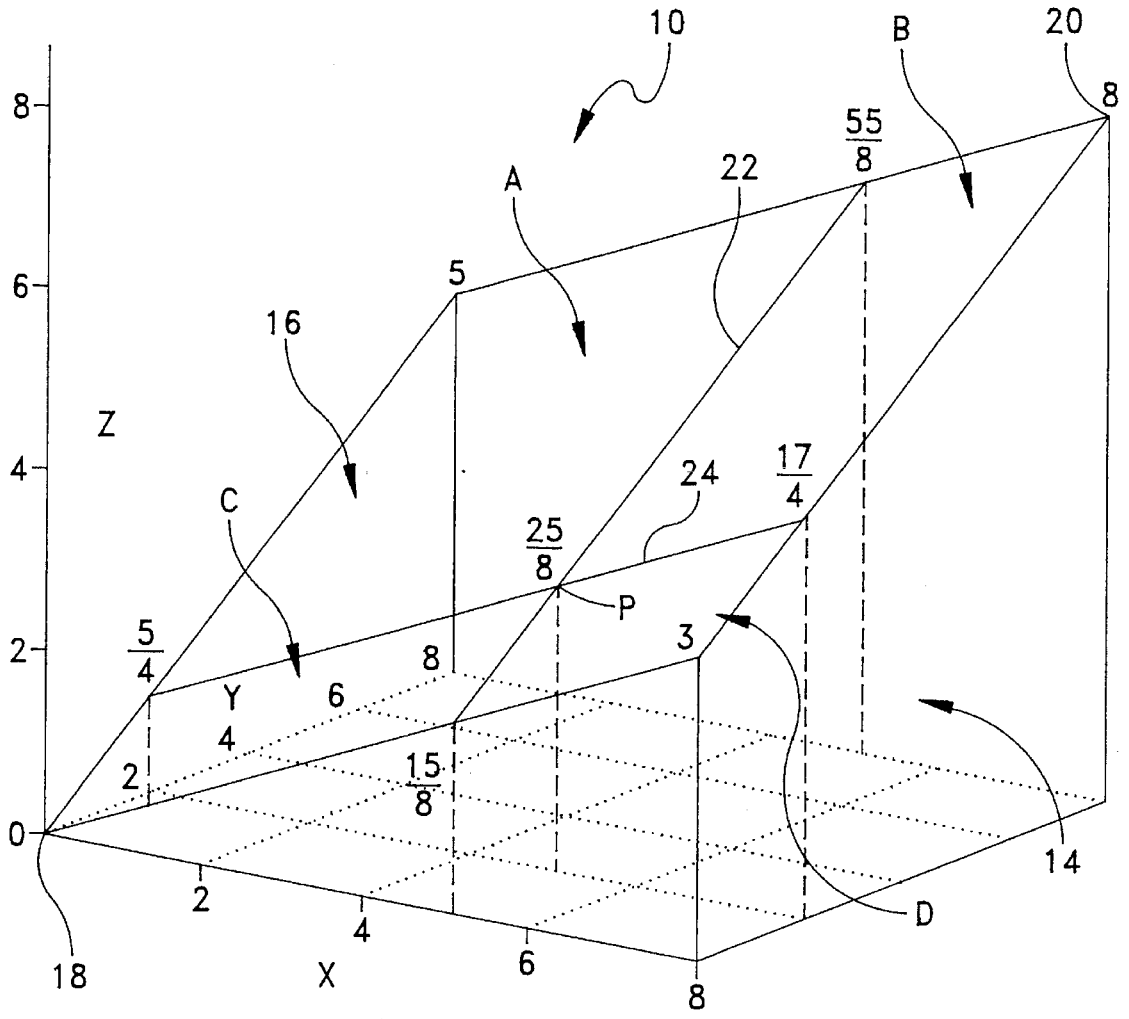
FIG. 5 is a graphical illustration of the lower block portion thereof having two vertical planar cuts formed therein parallel to the sides of the cube and perpendicular to each other to form first, second, third and fourth block sections.
Figure 7:
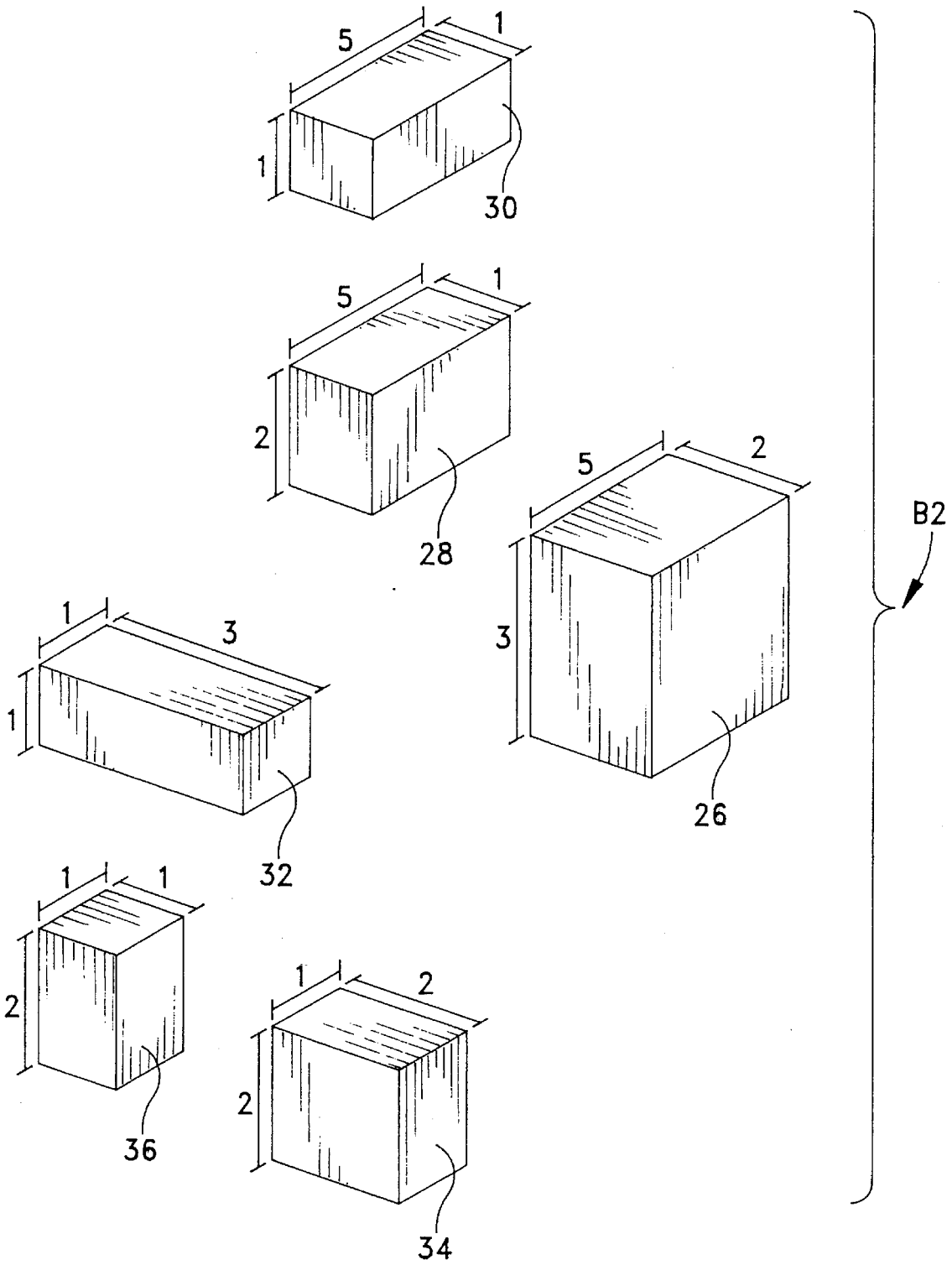
FIG. 7 is an exploded perspective view of the bottom piece thereof divided into six component elements.
Figure 8:
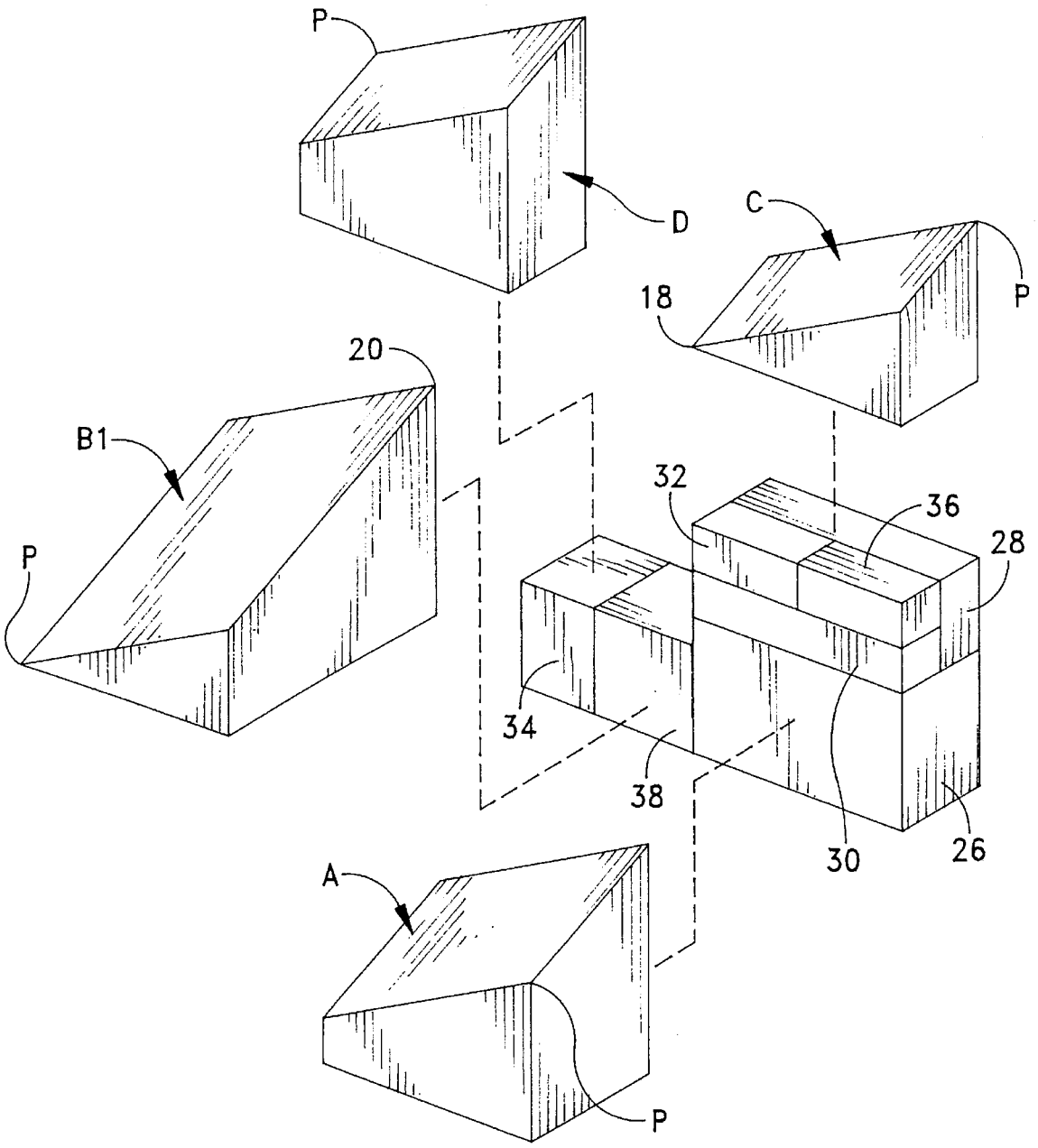
FIG. 8 is an assembly view of the block puzzle showing an alternative method of reassembly wherein an additional 2×2×2 cubic element is required to restore the original volume of the lower block portion.
Figure 9:
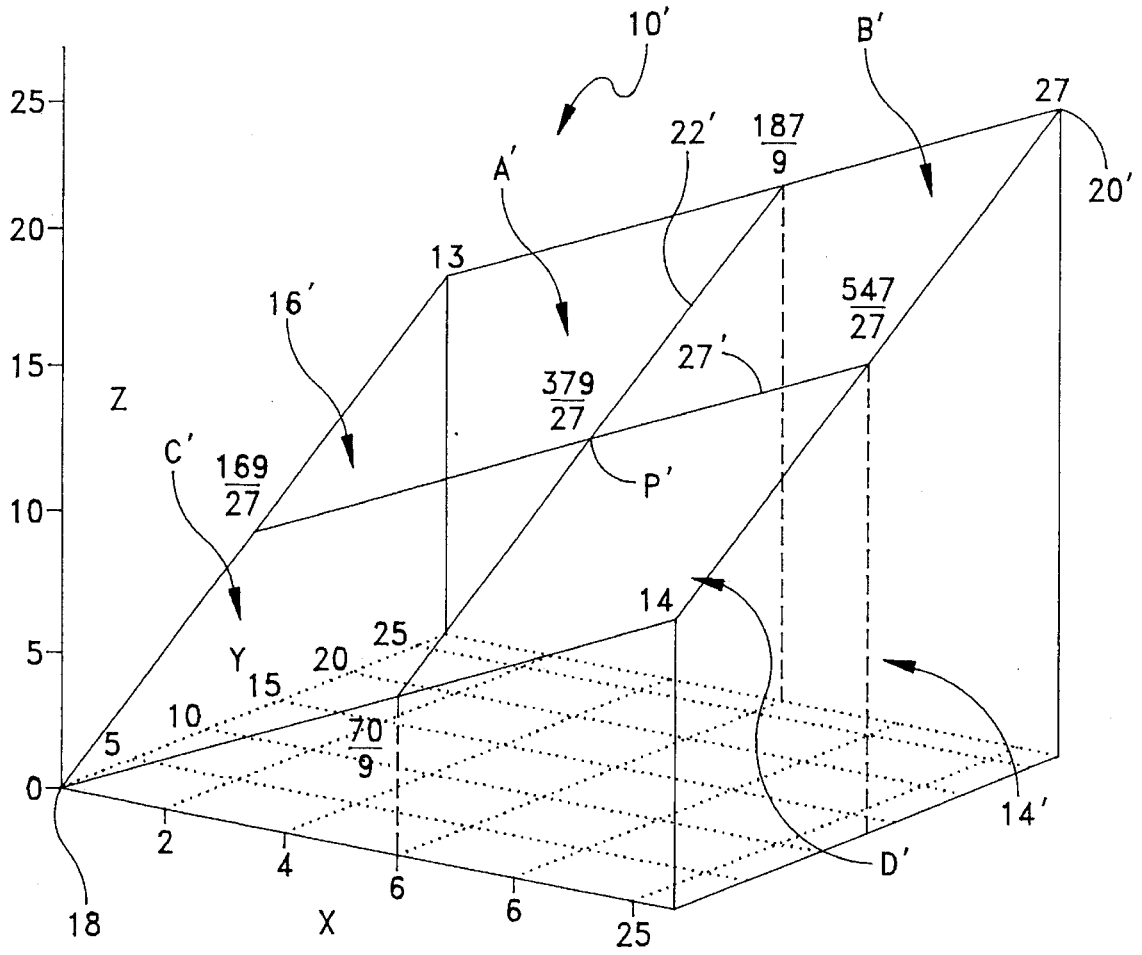
FIG. 9 is a graphical illustration of the truncated lower block portion of a 27×27×27 cubic block having two vertical planar cuts formed therein parallel to the sides of the cube and perpendicular to each other to form first, second third and fourth block sections.

Referring now to the drawings, a first embodiment of the instant cubic block construction is illustrated and generally indicated at 10 in FIGS. 4–8, while a second embodiment is illustrated and generally indicated at 10' in FIGS. 9–12. The cubic block constructions are separated into upper and lower block portions generally indicated at 12 and 14, respectively, along a plane 16 extending from the bottom, southwest corner 18 to the top northeast corner 20. The precise nature of this plane 16 is fundamental in the construction of the present invention, and is henceforth referred to as the separating plane. The equation of the separating plane 16 depends upon the choice of an even integer p or odd integer q>1 used to fix the dimensions of the cube 10 at $p^3 \times p^3 \times p^3$ or $q^3 \times q^3 \times q^3$, respectively. These two cases are treated in sections II and III, below, wherein vertical distances to the separating planes 16 and 16' are indicated in FIGS. 5 and 9, which illustrate the cases p=2 and q=3, respectively.

(II)

For any fixed even integer p, the dimensions of the cube 10 are $p^3 \times p^3 \times p^3$ and the equation of the separating plane 16 is given by $$z' = \frac{1}{p^3}\left(\left(\frac{1}{2}p^3 - 1\right)x + \left(\frac{1}{2}p^3 + 1\right)y\right). \tag{1}$$

It is evident, as in FIG. 5, that such a plane 16 passes through the origin (0,0,0) (point 18) and the point $(p^3,p^3,p^3)$ (point 20), as specified in I, above.

In order to locate a suitable point for the intersection of the two vertical cutting planes 22, 24 respectively (FIG. 5), it is necessary and sufficient to find a point P on the separating plane 16, with coordinates (x,y,z'), such that x and y take integer values in the range 1, 2, . . . , $p^3-1$, and the height z' exceeds an integer value by the smallest possible amount. Indeed, there is an entire family of suitable points P. How they are found is explained as follows.

In principle, any solution to the Diophantine equation $$\left(\frac{1}{2}p^3 - 1\right)x + \left(\frac{1}{2}p^3 + 1\right)y - p^3\hat{z} = 1, \tag{2}$$

furnishes such a point P, when x, y and $\hat{z}$ are positive integers in the range 1, 2, . . . , $p^3-1$. Assuming for the moment that such a solution exists, and dividing both sides of the equation by $p^3$, (2) takes the form $$\frac{1}{p^3}\left(\left(\frac{1}{2}p^3 - 1\right)x + \left(\frac{1}{2}p^3 + 1\right)y\right) - \hat{z} = \frac{1}{p^3}. \tag{3}$$

The parenthetical term on the left-hand side of (3) is recognized as the height z' in the equation of the separating plane, (1). Making this substitution from (1) into (3) gives $$z' - \hat{z} = \frac{1}{p^3}, \tag{4}$$

which asserts that the point on the separating plane 16 directly above the x and y coordinates supplied by (2) has a height in excess of the positive integer $\hat{z}$ by the amount $1/p^3$. The error $1/p^3$, by which the height fails to be a whole number, is the smallest non-zero error found at integer (x,y) points on the separating plane. The special role of this error in creating the illusion perpetrated by the present invention is explained in IV, below.

It is noteworthy that the Diophantine equation (2) arises naturally in the classical theory of the greatest common divisor (gcd) of a collection of positive integers. An equation of the form $$ax+by-cz=1,$$

where a, b and c are positive integers, has a solution in integers x, y and z if and only if a, b and c have a gcd equal to 1. Up to this point it has been assumed that such a solution to (2) exists.

Now, a family of solutions to (2) will be exhibited, from which follows a multiplicity of choices for the point P on the separating plane, (1). For any integer t, set $x=\pm\frac{1}{2}p^3+t$ and $y=1+t$. Then, let $\hat{z}=\frac{1}{4}p^3+t$ if the + option is chosen for x, otherwise let $\hat{z}=-\frac{1}{4}p^3+t+1$. It is verified by direct substitution that any such choice of x,y and $\hat{z}$ is a solution to (2).

FIG. 5 shows the case p=2, where the equation of the separating plane 16 is $z'=\frac{1}{8}(3x+5y)$. It follows that the (x,y)-coordinates (4,1), (5,2), (6,3), (7,4), (1,6) and (2,7) are suitable for the location of P. FIG. 5 shows x=5, y=2 and $z'=\frac{25}{8}$ as the particular choice of P. The significance of this choice is only that it places P close to the center of the cube, an aesthetic feature that also economizes the dissection.

Figure 6:
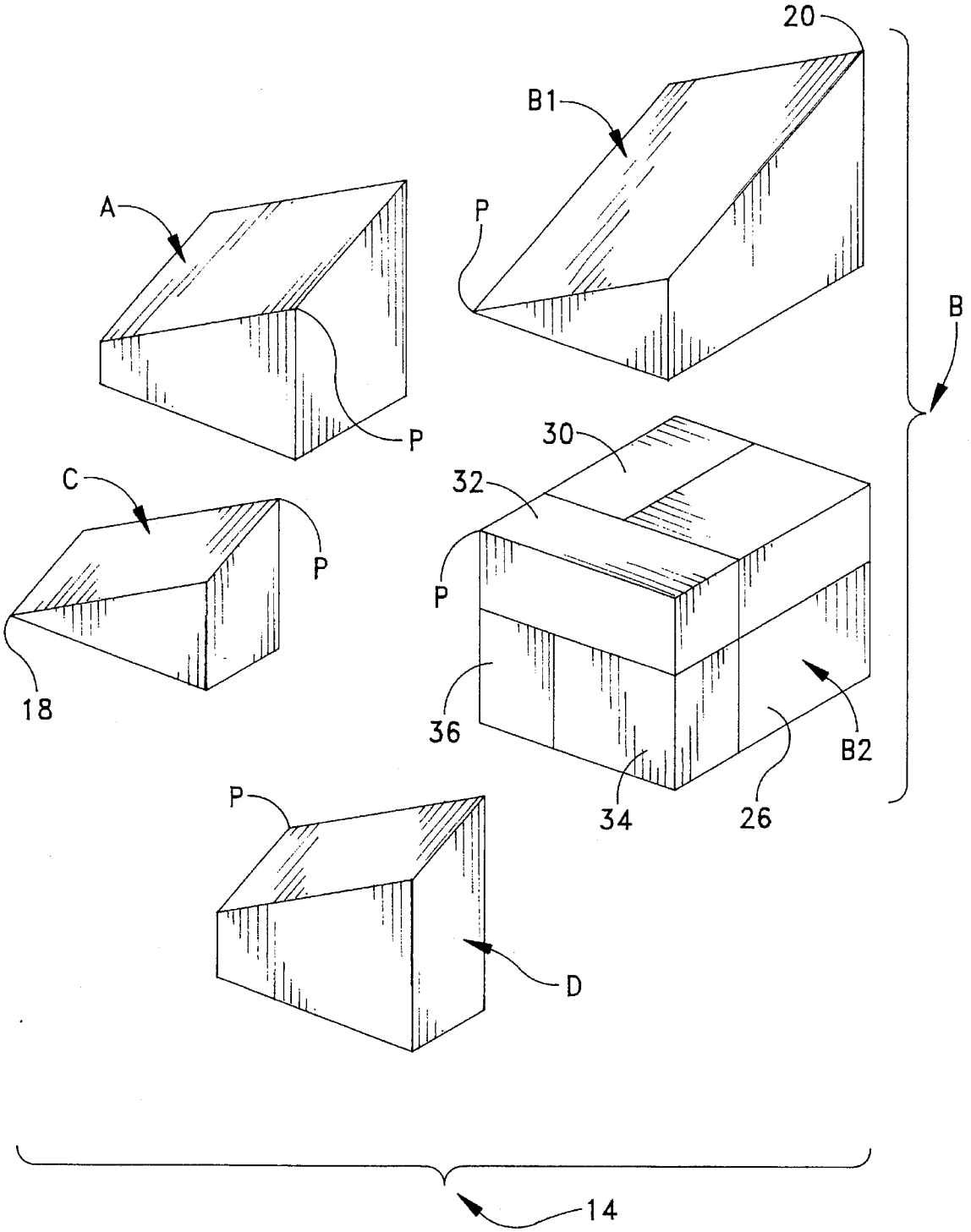
FIG. 6 is an exploded perspective view thereof with the second block section divided along a horizontal plane into top and bottom pieces.

Vertical cutting planes 22, 24 extend parallel to the sides of the cube and are perpendicular to each other, intersecting at point P. These vertical planes 22, 24 divide the lower block portion into first, second, third and fourth sections generally indicated at A, B, C, D. Turning to FIG. 6, block section B receives an additional horizontal planar cut parallel to the base of the cube, so as to separate the section B into top and bottom pieces B1 and B2. In this regard, it is pointed out that the horizontal planar cut does not pass exactly through point P, rather it is the closeness of this intersection which is at the heart of the present puzzle illusion. Bottom piece B2, the tallest rectangular solid of integer height formed from section B, is then further divided it into six rectangular component elements 26, 28, 30, 32, 34, and 36 having the particular dimensions as illustrated in FIG. 7.

Referring to FIG. 8, it is now possible to rearrange all the pieces in space so that the original truncated cube shape is restored. However, reassembly of the pieces in the manner illustrated results in an interior cubic void having the dimension 2×2×2. As stated previously, the size of this void depends on the dimensions of the original cube. Filling the void requires an additional 2×2×2 cubic piece 38 which was not one of the totality of pieces divided from the original cube. The missing volume is actually transferred to the vertical peripheral edges of the cube so that the height of the structure is increased by $1/p^3$ or ⅛ of one unit. This increase in height is usually imperceptible to the human eye when viewing the structure. The mathematical details of the illusion are more clearly discussed in section IV below.

(III)

Referring to FIG. 9, for any fixed odd integer q>1, the dimensions of the cube 10' are $q^3 \times q^3 \times q^3$ and the equation of the separating plane 16' is $$z' = \frac{1}{2q^3}\left((q^3+1)x + (q^3-1)y\right). \tag{5}$$

It is evident, as in FIG. 9, that such a plane 16' passes through the origin (0,0,0) (point 18') and the point $(q^3,q^3,q^3)$ (point 20'), as specified in I, above. The preceding analysis in II is applied to the present case of an-odd integer q with completely analogous results.

The determination of a family of points P' (FIG. 9) for the location of the two vertical cutting planes is accomplished by solving the Diophantine equation $$\frac{1}{2}(q^3+1)x + \frac{1}{2}(q^3-1)y - q^3\hat{z} = 1. \tag{6}$$

Dividing both sides of (6) by $q^3$ gives $$\frac{1}{2q^3}(q^3+1)x + \frac{1}{2q^3}(q^3-1)y - \hat{z} = \frac{1}{q^3}, \tag{7}$$

and the height z' in (5), above, is recognized at once on the left-hand side of (7). Making this substitution in (7) expresses the discrepancy error as $$z' - \hat{z} = \frac{1}{q^3}, \tag{8}$$

the precise analogue of (4) in II, above.

It remains to exhibit a family of solutions to (6), from which follows a multiplicity of choices for the point P' on the separating plane, (5). It is verified by direct substitution that, for any integer t, the following integers x, y and $\hat{z}$ solve (6): x=t+1, y=t−1, $\hat{z}$=t.

In FIG. 9, the equation of the separating plane 16' is z'=1/27(14x+13y). With t=14, it follows that x=15, y=13 and z'=379/27 are the coordinates of P'. As indicated at the end of II, above, this choice is preferred due to its proximity to the center of the cube.

Figure 10:
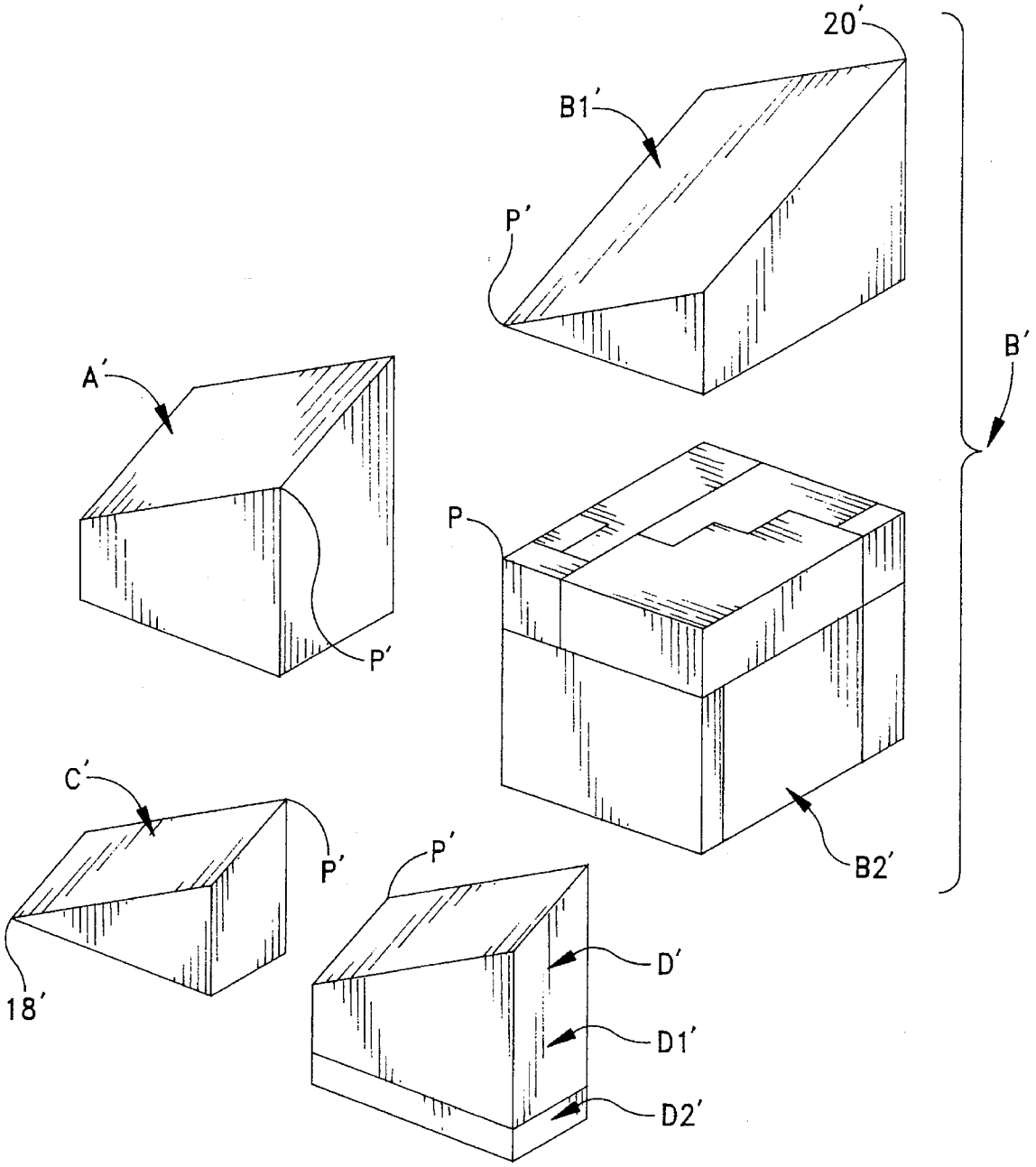
FIG. 10 is an exploded perspective view thereof with the second and fourth block sections divided along horizontal planes into top and bottom pieces.
Figure 11:
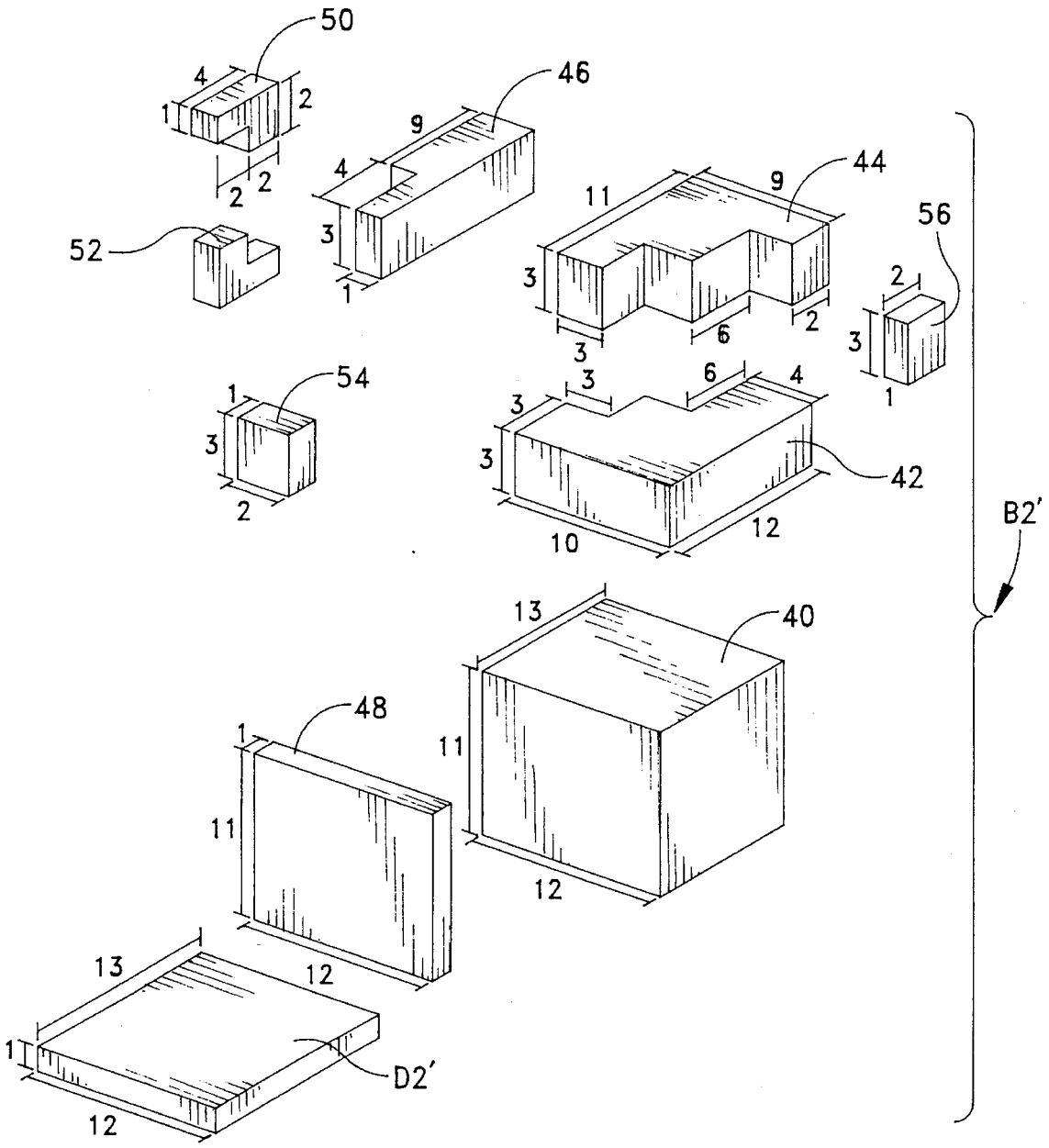
FIG. 11 is an exploded perspective view showing the bottom piece of the second section divided into nine component elements, and further showing the bottom piece of the fourth section.

Vertical cutting planes 22', 24' extend parallel to the sides of the cube and perpendicular to each other passing through point P'. These vertical planes 22', 24' divide the lower block portion 14' into first, second third and fourth sections generally indicated at A', B', C', D'. Turning to FIG. 10, block section B' receives an additional horizontal planar cut parallel to the base of the cube, so as to separate the section B' into top and bottom pieces B1' and B2'. Consistent with the method of perpetrating the puzzle illusion, the planar cut does not pass exactly through point P', rather the-bottom piece B2 comprises the tallest possible rectangular solid with exact integer height formed from the section. Bottom piece B2' is then further divided into 9 rectangular component elements 40, 42, 44, 46, 48, 50, 52, 54, and 56 (FIG. 11) having the particular dimensions illustrated therein. Furthermore, block section D' also receives an additional horizontal planar cut parallel to the base of the cube, so as to separate the section D' into top and bottom pieces D1' and D2'. The bottom piece D2' has a height of 1 unit as illustrated in FIG. 11.

Figure 12:
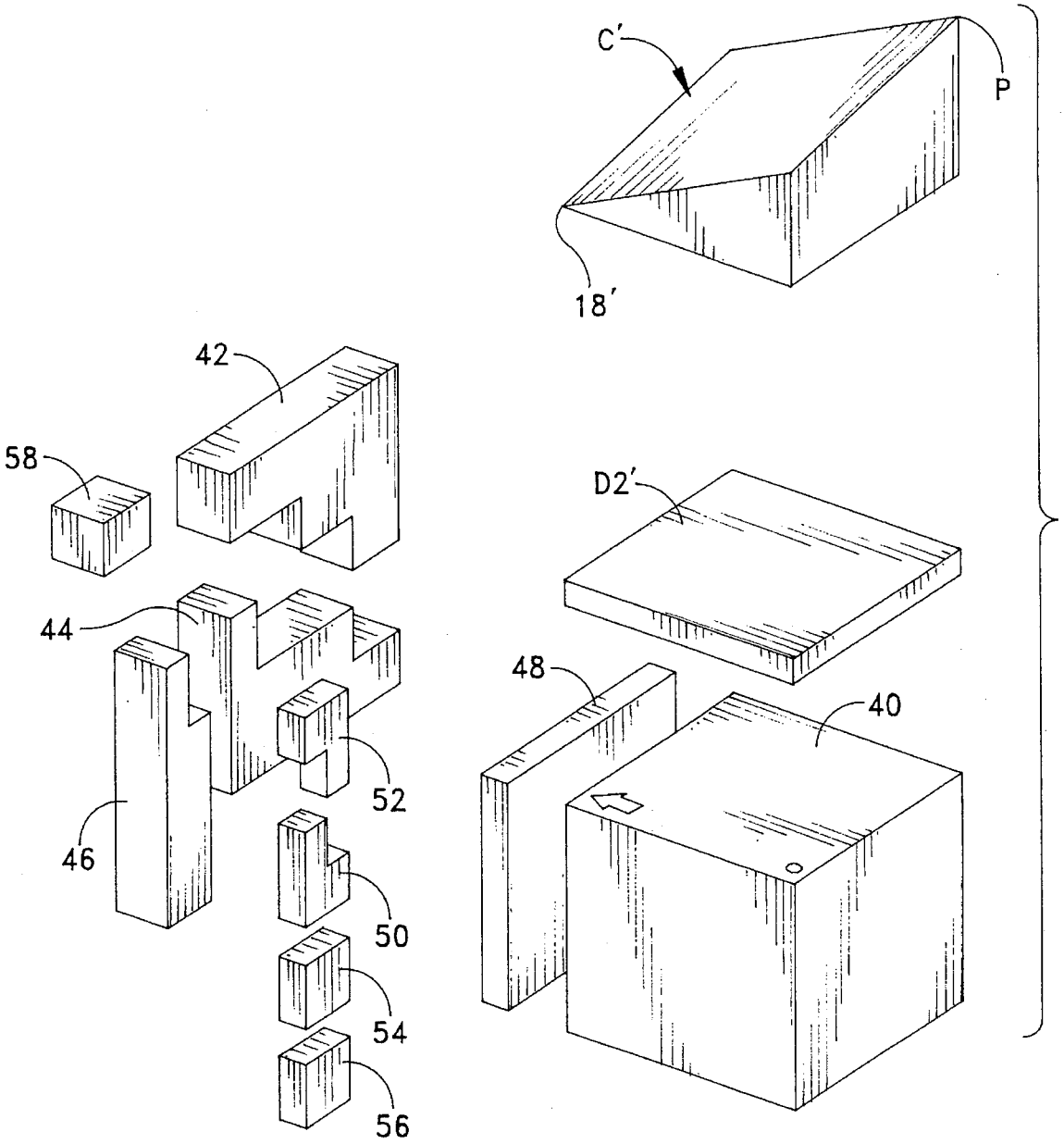
FIG. 12 is an assembly view of one section of the block puzzle showing an alternative method of reassembly wherein an additional 3×3×3 cubic element is required to restore the original volume of the lower block portion.
Figure 13:
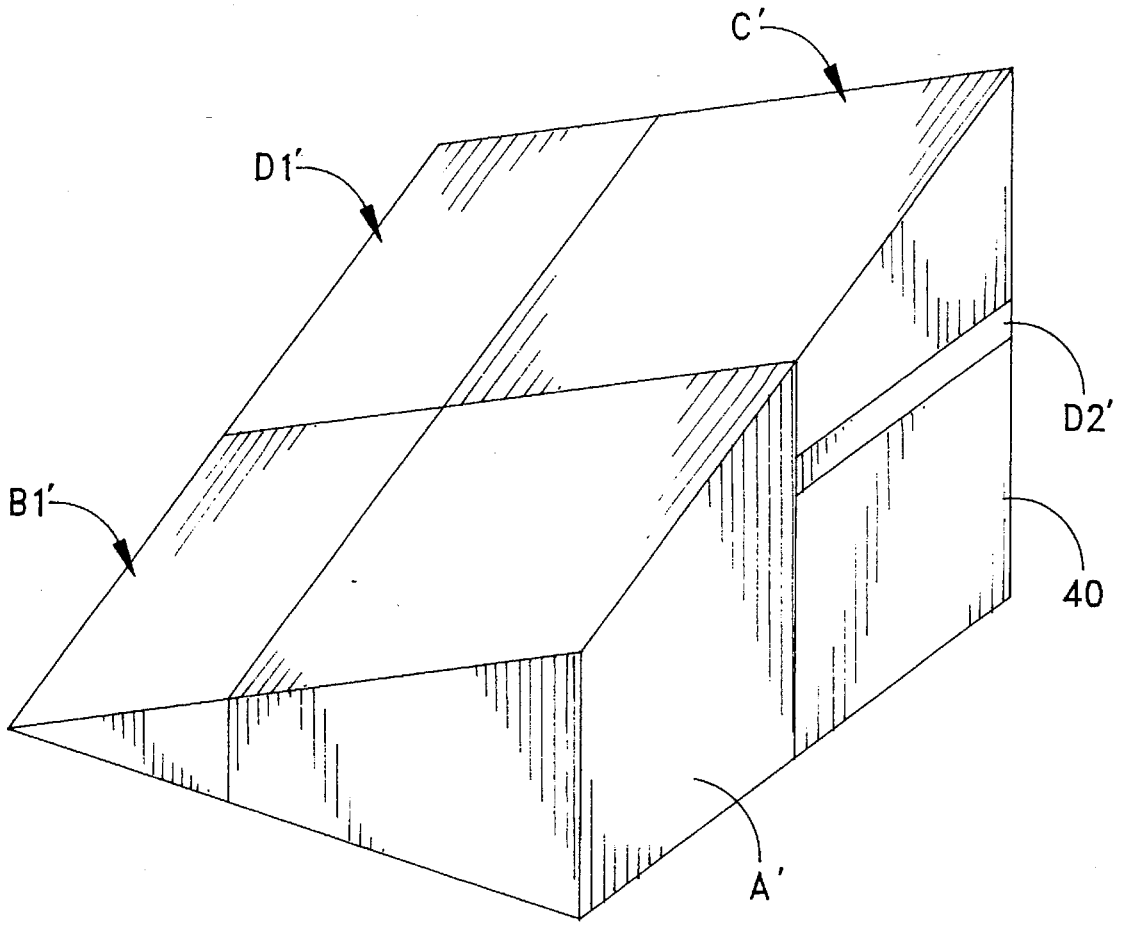
FIG. 13 is an assembly view of block puzzle with all four sections reassembled in the alternative configuration.

Referring to FIG. 12, it is now possible to rearrange all the pieces in space so that the original truncated cube shape is restored, with the exception of an interior cubic void having the dimension 3×3×3. The void appears between the two pieces 42, 44 when they are stacked on top of each other as illustrated. Filling the void requires an additional 3×3×3 cubic piece 58 which was not included in the totality of pieces divided from the original cube.

(IV)

As illustrated in FIGS. 5 and 9 for the even and odd cases, respectively, the point P serves as the intersection point of the separating plane 16 with two mutually perpendicular planes 22, 24 parallel to the vertical sides of the cube, which divide the truncated cube into four blocks labelled A,B,C and D. Equations (4) and (8), above, show that the height of P approximates an integer value from above with a minimum error of $1/r^3$ for a cube with integer dimensions $r^3 \times r^3 \times r^3$, r>1 (r now covers both cases: even integers p and odd integers q>1).

The illusion of the present invention is perpetrated by transmitting this error from the center of the cube to the four vertical edges by rearranging the pieces so that the final assembly is no longer truly a cube, but is imperceptibly taller than a cube by the amount $1/r^3$. Since the base area of the cube is $r^3 \cdot r^3$, an increase in height of $1/r^3$ increases the volume by $1/r^3 \cdot r^3 \cdot r^3$ or $r^3$, precisely the volume of a smaller cube of dimension r×r×r. This is a void which must appear when the blocks are rearranged since mass is, after all, conserved. The precise rearrangement is described in V, below.

For example, in the case r=q=3 with the unit of measurement set at ¼", the basic cube has a size of 6.75". When the pieces are rearranged, the height increases by a mere 1/108". Construction material with even a small amount of compressibility could probably absorb this increase, so that the blocks would return comfortably to their form-fitting container with the ¾" cubic void now filled by the extra piece.

(V)

FIGS. 6–8 are the continuations of FIG. 5, and FIGS. 10–12 are the continuations of FIG. 9. FIGS. 6–8 and 10–12 thus show the spatial rearrangement that transmits the aforementioned error $1/r^3$ at point P to the four vertical edges of the cube. The pair of blocks A and D, and the pair of blocks B and C exchange places by lateral translation. Further dissections are introduced to enable the reconstruction of the pieces into what appears to be the original truncated cube shape. As explained in IV, above, this appearance is deceptive because the completed structure is no longer a cube, but is actually taller than a cube by $1/r^3$. However, the change in height is imperceptible to the human eye.

(VI)

In the first embodiment (FIGS. 5–8) it is pointed out that the volume change involves a small cube with side-length 2, or a length which is $2/8=25\%$ of the dimension of the basic cube. However, in the second embodiment (FIGS. 9–12) this relative size shrinks drastically to $3/27=1/9=11\%$. However, it is possible to modify the design so that the extra cube has a relative side-length that falls somewhere between these two values; for concreteness, say 16%.

This type of problem is solved by a familiar extension of the Diophantine methods used in II and III, above. The 1 on the right-hand side of the prototype equation $$ax+by-cz=1 \tag{9}$$

is replaced by $n^3$, where n is an integer satisfying $1<n<r$ for a basic cube of dimension $r^3 \times r^3 \times r^3$. It is now a matter of solving $$ax+by-cz=n^3 \tag{10}$$

in suitable integers x, y and z. This is always possible in two steps if (9) is solvable in integers, which it was in the case of (2) and (6), above.

The first step is to take any solution to (9) and multiply both sides of the equation by $n^3$. For example, when r=q=5, one solution to (9)–(6), $$63x+62y-125\hat{z}=1, \tag{11}$$

is X=3, y=1 and $\hat{z}=2$. Take n=4, and multiply across both sides of (11) by $n^3=64$ to obtain the solution to $$63X+62Y-125\hat{Z}=64, \tag{12}$$

$X=64x=192$, $Y=64y=64$ and $\hat{Z}=64\hat{z}=128$, This completes the first step.

The second step is necessary because only one of these values, Y=64, is in the range 1,2, . . . , 125. An adjustment is required in order to locate the point P inside the 125×125×125 cube, since X=192 is not a feasible choice. The adjustment is simply to subtract and add $a \cdot c=63 \cdot 125$ on the left hand side of (12), above. The equation becomes $$63(X-125)+62Y-125(\hat{Z}-63)=64. \tag{13}$$

The effect is to pull X and $\hat{Z}$ back into the proper range, and gives a feasible solution to (12):

$$X=67,\ Y=64,\ \hat{Z}=65. \tag{14}$$

Starting with other solutions to (11), the trick of subtraction/addition can be used as many times as necessary to generate a feasible solution to (12) and, more generally, to (10). Then, since a+b=c, further adjustments in the location of P are possible by using the subtraction/addition trick with a+b and c. For example, $$X=63,\ Y=60,\ \hat{Z}=61 \tag{15}$$

is another feasible solution to (12).

Proceeding as before, the height error, which is the source of the illusion in the present invention, becomes $$z'-\hat{z}=\left(\frac{n}{r}\right)^3. \tag{16}$$

Thus, the volume increase of the rearranged cube, $(n^3/r^3) \cdot r^3 \cdot r^3=(n \cdot r)^3$, is the volume of a smaller cube of side-length n·r. The percentage fraction of the dimension of the large cube is, for this side-length, $$\frac{n \cdot r}{r^3}=\frac{n}{r^2}. \tag{17}$$

The additional parameter n introduces a second degree of freedom, allowing this percentage fraction to be fine-tuned accordingly.

For example, when n=4 and r=q=5, locating P at (x,y) coordinates (63, 60) leads to a cubic void of side-length $20=4 \cdot 5$. As a percentage of the total length, $20/125=16\%$. Therefore, if the basic unit of construction is set at 1/25", the puzzle is a 5 inch cube with a smaller 4/5" cube. The height discrepancy which accounts for the illusion of matter created and destroyed works out to $4^3/5^5=0.02048$", or about one-fiftieth of an inch.

Figure 14:
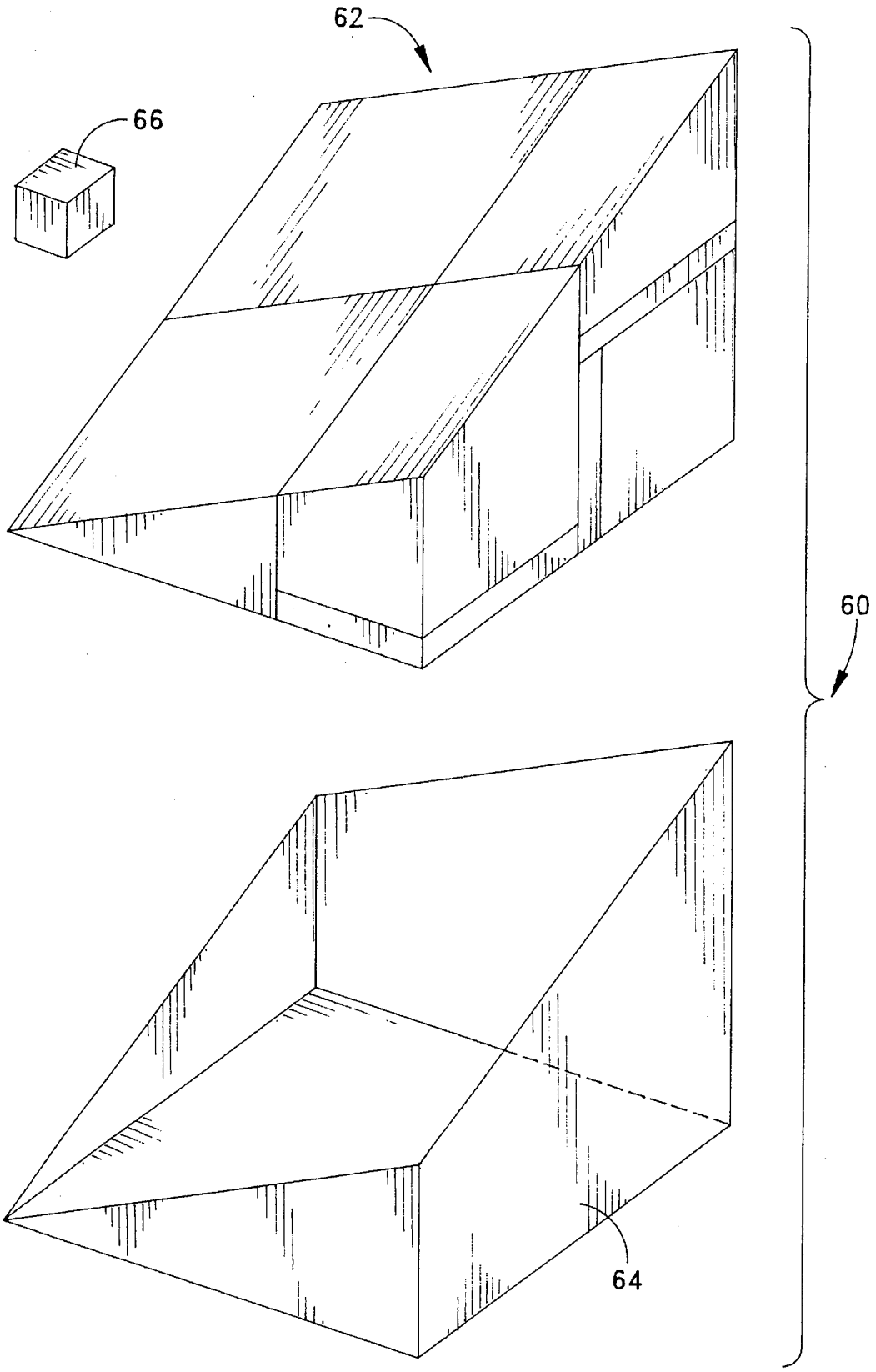
FIG. 14 is an exploded perspective view of a commercial embodiment of the block puzzle, including a transparent open-top container for receiving the puzzle pieces, and further including an additional cubic element to be reassembled with the puzzle pieces within the boundaries of the container.

As a commercial puzzle (FIG. 14), a puzzle assembly 60 would include a divided, truncated cube 62, together with a transparent, open top container 64 and a cubic element 66 to be added to the puzzle when it is reassembled into the container, apparently without increasing the volume. The cube 62 is illustrated in the form of the second embodiment 10', having a total of 14 pieces. The container 64 has transparent side and bottom walls which have top peripheral edges generally identical to the upper peripheral edges of the truncated cube, such that the cube fits snugly within the walls through the open top thereof. The cubic element 66 is of appropriate size to be reassembled with the puzzle pieces into the container 64.

Figure 15A:
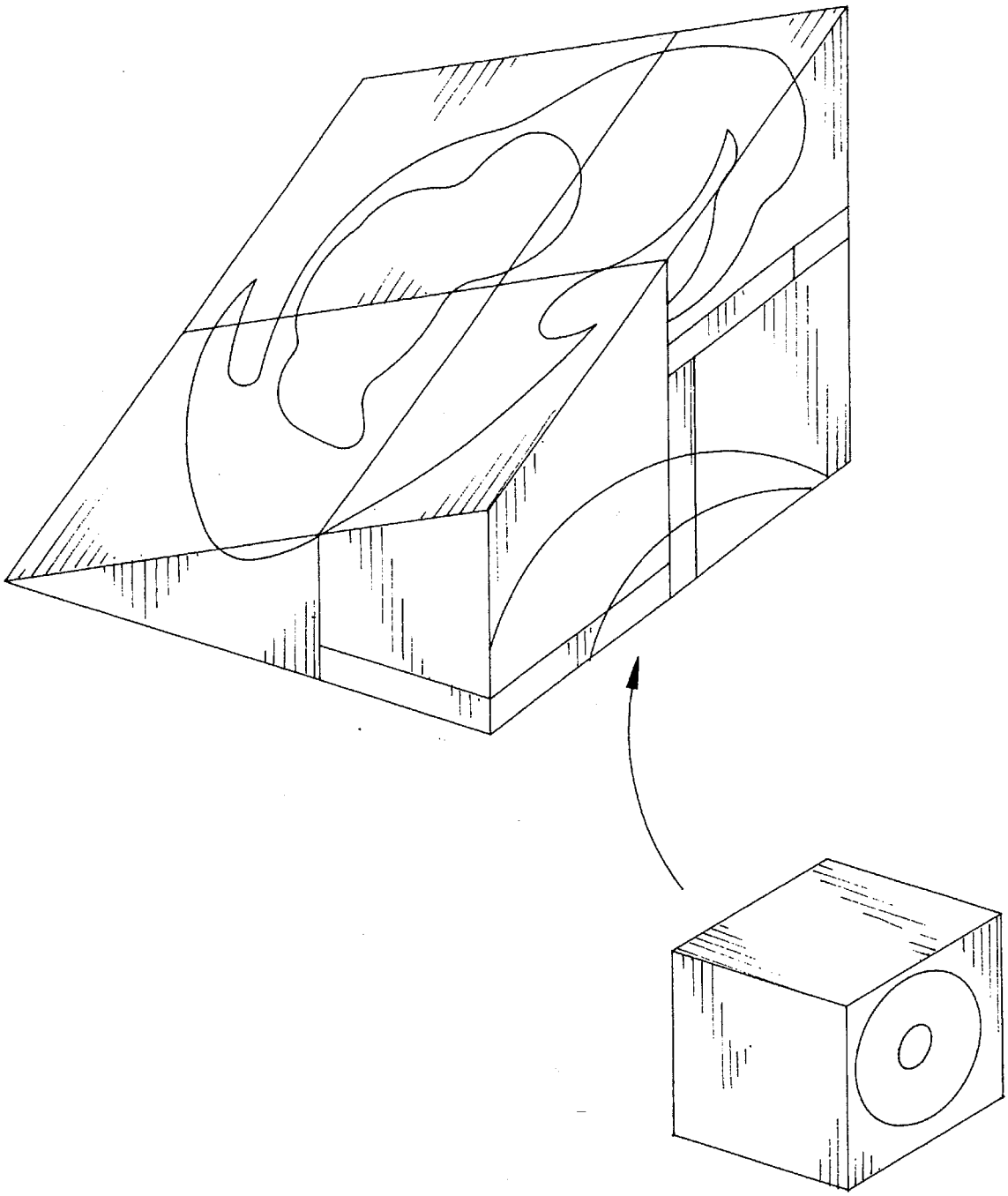
FIGS. 15A–15C are graphical illustrations of alternative commercial embodiments.
Figure 15B:
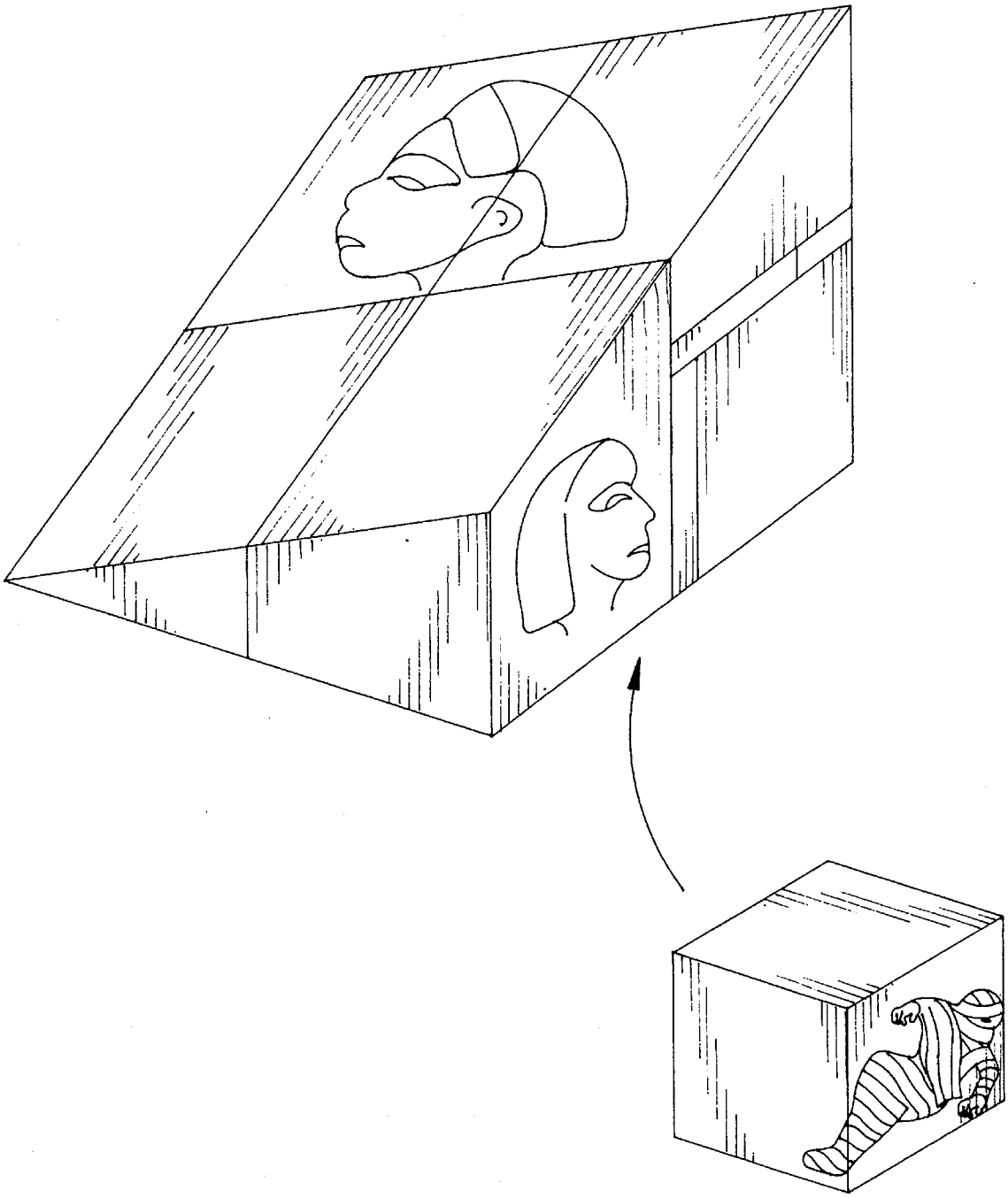
Figure 15C:
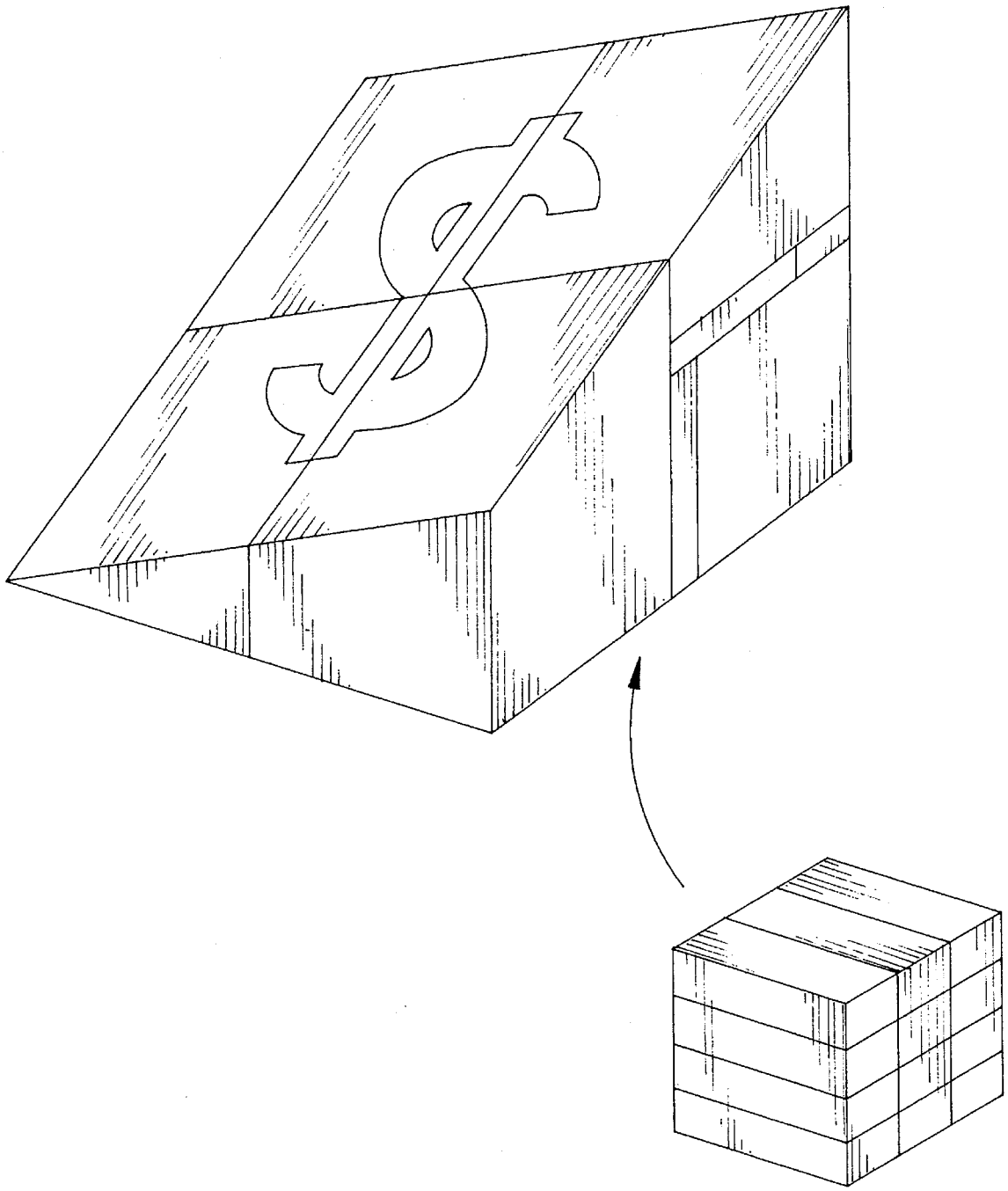

It is noted that the puzzle construction can be decorated in any number of attractive motifs. For example, a Deep Space version (FIG. 15A) with external surface designs featuring galaxies and nebulae can have the previously described void playing the role of a black hole. Furthermore, a Mummy's Tomb design (FIG. 15B) exploits the vaguely pyramidal shape of the truncated cube, with the 26 blocks finished in a pattern suggesting ancient stone. The additional cubic piece, featuring a small figure of the "mummy", must be located within the reassembled blocks in order to complete the Mummy's Tomb and restore eternal peace to its tortured, and potentially malevolent resident. Still further, a Midas Machine version (FIG. 15C) could be decorated in a pattern suggesting gold bars. In this case, the puzzle works in the reverse order of the two preceding examples. When the blocks are reassembled, an extra gold cube is left over, yet the remaining pieces fill the same apparent volume as before. This means that the remaining pieces, if truly made out of gold, could be melted down and subdivided again to permit the withdrawal of another surplus gold cube from the rearranged pieces, which could be melted down yet again, ad infinitum. The paradoxical nature of the puzzle would seem to yield, for those willing to carry the Midas Machine to its alchemical conclusion, a never-ending supply of gold cubes.

In a version entitled "The Great Red Spot," (not shown) the top half of the cube receives a similar dissection as the bottom half, with all its pieces colored red, including a small red cube. The bottom half has all its pieces colored blue. The objective is to reconstruct the cube with only the small red cube residing among the same blue pieces in the bottom half.

A similarly undecorated form is seen as appropriate for the most advanced uses of the puzzle as a didactic instrument in courses in number theory.

Every instance offers the solver the potential of satisfaction on three levels, each deeper than the next: (1) simply finding the two different ways of reconstructing the cube; (2) recognizing how one configuration can leave a physical void while the other does not; (3) apprehending the elegant mathematical abstractions reflected in the design.

Indeed, the design need not be restricted to commercial renderings as a puzzle, since it has the additional interpretation as sculpture. The elegance, simplicity and unexpectedness combine to produce an enigmatic art object for those able to perceive it.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A puzzle construction comprising a cubic block having the dimensions $p^3 \times p^3 \times p^3$, wherein p is an even positive integer, said cubic block comprising upper and lower block portions divided along a plane defined by the following formula:

$$z' = \frac{1}{p^3}\left(\left(\frac{1}{2}p^3 - 1\right)x + \left(\frac{1}{2}p^3 + 1\right)y\right)$$

said lower block portion comprising first, second, third and fourth sections which are divided along two vertical planar cuts extending parallel to the block sides and perpendicular to each other, said cuts intersecting at a point P within said plane and having the coordinates x, y, z', wherein for any integer t, $x = \pm\frac{1}{2}p^3 + t$ and $y = 1 + t$, and further wherein x and y are integers in the range 1 to $p^3 - 1$, said second block section comprising top and bottom pieces divided along a horizontal plane extending through a point located $1/p^3$ units below said point P so that said bottom piece has maximal integer height, said bottom piece comprising a plurality of rectangular elements.

2. The puzzle construction of claim 1 further comprising a second cubic block having the dimensions $p \times p \times p$.

3. The puzzle construction of claim 2, wherein said second cubic block has the dimensions $p \cdot n$ for an independently chosen integer parameter n.

4. A method of constructing a puzzle comprising the steps of:

providing a cubic block having the dimensions $p^3 \times p^3 \times p^3$ wherein p is an even positive integer; dividing said cubic block into upper and lower block portions along a plane defined by the following formula:

$$z' = \frac{1}{p^3}\left(\left(\frac{1}{2}p^3 - 1\right)x + \left(\frac{1}{2}p^3 + 1\right)y\right)$$

dividing said lower block portion into first, second, third and fourth sections along two vertical planar cuts extending parallel to the block sides and perpendicular to each other, said cuts intersecting at a point P within said plane and having the coordinates x, y, z', wherein for any integer t, $x = \pm\frac{1}{2}p^3 + t$ and $y = 1 + t$, and further wherein x and y are integers in the range 1 to $p^3 - 1$;

dividing said second block section into top and bottom pieces along a horizontal plane extending through a point located $1/p^3$ units below said point P so that said bottom piece has maximal integer height; and dividing said bottom piece into a plurality of rectangular sub-elements.

5. The method of claim 4 further comprising the step of reassembling said cubic block with a second cubic block having the dimensions $p \times p \times p$ such that said reassembled puzzle construction has a height of $p^3 + 1/p^3$.

6. The method of claim 5, wherein said second cubic block has the dimensions $p \cdot n$ for an independently chosen integer parameter n.

7. A puzzle construction comprising a cubic block having the dimensions $q^3 \times q^3 \times q^3$, wherein q is an odd integer greater than 1, said cubic block comprising upper and lower block portions divided along a plane defined by the following formula:

$$z' = \frac{1}{2q^3}((q^3 + 1)x + (q^3 - 1)y)$$

said lower block portion comprising first, second, third and fourth sections which are divided along two vertical planar cuts extending parallel to the block sides and perpendicular to each other, said cuts intersecting at a point P within said plane and having the coordinates x, y, z', wherein for any integer t, $x = t + 1$ and $y = t - 1$, and further wherein x and y are integers in the range 1 to $q^3 - 1$, said second block section comprising top and bottom pieces divided along a horizontal plane extending through a point located $1/q^3$ units below said point P so that said bottom piece has maximal integer height, said bottom piece comprising a plurality of rectangular sub-elements.

8. The puzzle construction of claim 7 further comprising a second cubic block having the dimensions $q \times q \times q$.

9. The puzzle construction of claim 8, wherein said second cubic block has the dimensions $q \cdot n$ for an independently chosen integer parameter n.

10. A method of constructing a puzzle comprising the steps of:

providing a cubic block having the dimensions $q^3 \times q^3 \times q^3$; wherein q is an odd integer greater than 1, dividing said cubic block into upper and lower block portions along a plane defined by the following formula:

$$z' = \frac{1}{2q^3}((q^3 + 1)x + (q^3 - 1)y)$$

dividing said lower block portion into first, second, third and fourth sections along two vertical planar cuts extending parallel to the block sides and perpendicular to each other, said cuts intersecting at a point P within said plane and having the coordinates x, y, z', wherein for any integer t, $x = t + 1$ and $y = t - 1$, and further wherein x and y are integers in the range 1 to $q^3 - 1$;

dividing said second block section into top and bottom pieces along a horizontal plane extending through a point located $1/q^3$ units below said point P so that said bottom piece has maximal integer height; and dividing said bottom piece into a plurality of rectangular sub-elements.

11. The method of claim 10 further comprising the step of reassembling said cubic block with a second cubic block having the dimensions $p \times p \times p$ such that said reassembled puzzle construction has a height of $q^3 + 1/q^3$.

12. The method of claim 11, wherein said second cubic block has the dimensions $q \cdot n$ for an independently chosen integer parameter n.

* * * * *